US005589676A

United States Patent [19]

Iguchi

[11] Patent Number: 5,589,676

[45] Date of Patent: Dec. 31, 1996

[54] ELECTRONIC CASH REGISTER SYSTEM

[75] Inventor: Kesayoshi Iguchi, Fujisawa, Japan

[73] Assignee: Matsushita Electric Industrial Co., Ltd., Osaka, Japan

[21] Appl. No.: 407,627

[22] Filed: Mar. 21, 1995

[30] Foreign Application Priority Data

May 27, 1994 [JP] Japan ..... 6-115423

[51] Int. Cl.[6] ..... G07G 1/00

[52] U.S. Cl. ..... 235/7 R; 340/825.35

[58] Field of Search ..... 235/7 R, 383; 340/825.35, 825.28, 825.52; 364/401, 404, 405

[56] References Cited

U.S. PATENT DOCUMENTS 5,128,862 7/1992 Mueller ..... 364/405
5,377,097 12/1994 Fuyama et al. ..... 364/401

FOREIGN PATENT DOCUMENTS 329082 2/1991 Japan .
3110668 5/1991 Japan .

*Primary Examiner*—Patrick J. Stanzione
*Attorney, Agent, or Firm*—Watson Cole Stevens Davis, P.L.L.C.

[57] ABSTRACT

An electronic cash register system in which, when a customer orders a menu at an order register, the order register transmits to a display control unit the ordered menu items and the register number of the order register. The display control unit stores the ordered menu items in its internal memory together with the register number of the order register and displays the ordered menu items on a display unit. The customer accounts for the order at an account register. The operator of the account register manipulates the account register to read out the ordered menu items registered in the display control unit. The display control unit reads out from its internal memory the ordered menu items accepted at the order register having the same register number as that of the account register and transmits the read-out ordered menu items to the account register. The operator of the account register accounts for the read-out ordered menu items.

4 Claims, 14 Drawing Sheets

EXAMPLE OF PRINTED ORDER SLIP

ACCOUNT OPERATION

EXAMPLE OF PRINTED ACCOUNT SLIP

ORDER INPUT OPERATION

EXAMPLE OF ACCOUNT OPERATION

ELECTRONIC CASH REGISTER SYSTEM

BACKGROUND OF THE INVENTION

1. Field of the Invention

This invention relates to an electronic cash register system widely used in fast food restaurants, drive-through restaurants or the like to display a menu ordered by a customer on a display screen of a display unit installed in the kitchen and to ensure accurate accounting for the order by the customer.

2. Description of the Related Art

An accounting system employed hitherto in many fast food restaurants, drive-through restaurants and the like operates such that, as soon as a menu ordered by a customer is prepared or cooked and then delivered to the customer, the customer pays money corresponding to the ordered menu. In a prior art electronic cash register system used in such an accounting system, a master electronic cash register and a plurality of slave electronic cash registers are located at a service counter, while a display unit and a control key are located in the kitchen. According to this prior art electronic cash register system, each of the slave electronic cash registers registers an order received from a customer and issues an order slip, while the master electronic cash register collects that information. The names of the menu items to be cooked are displayed on the display screen of the display unit according to the information transmitted from the master electronic cash register, and the cooks cook the menu items on the basis of the displayed names. When the article or the menu items cooked and prepared according to the orders from the customers are delivered to the service counter, the customers receive the ordered menu items in exchange for the order slips and pay money for the menu items totalled by the individual registers.

One form of the prior art electronic cash register system will now be described by reference to FIGS. 1 to 7. Referring to FIG. 1, each of slave registers 10 is located at, for example, a service counter to register a menu order from a customer and to issue a bill for the order. A master register 11, which also registers a menu order and issues a bill for the order, functions to store order numbers, ordered menu items, etc. This master register 11 issues the order number each time any one of the slave registers 10 receives a menu order. Each of the registers 10 and 11 issues a printed slip 12 on which the order number, the ordered menu items, the total price, etc. are printed.

A display unit 13 as a means for displaying the order numbers and ordered menu items on its display screen is located in the kitchen. A display control unit 14, as a means for controlling the display unit 13, stores the order numbers, ordered menu items, etc. transmitted from the registers 10 and 11 and displays the ordered menu items on the display screen of the display unit 13 in the order of the order numbers. A control key 16, as an actuator means for controlling the display on the display unit 13, is connected to the display control unit 14. Referring to FIG. 2, the control key 16 includes a left shift key 17 for shifting the cursor leftward on the display screen of the display unit 13, a right shift key 18 for shifting the cursor rightward on the display screen of the display unit 13, and a serve key 19 for erasing, in response to depression of the key 19, the ordered menu items of the order number where the cursor is now located. The slave registers 10, the master register 11 and the display control unit 14 are interconnected by a communication line 20.

The operation of the prior art electronic cash register system will now be described. A customer orders, for example, a meal made up of one or more menu items to the operator of the slave or master register 10 or 11. In response to the order from the customer, the register operator manipulates keys shown in FIG. 3. When the operator manipulates an order number key 21 on the slave or master register 10 or 11, the master register 11 is inquired for that order number. In response to the inquiry of the order number from the slave register 10, the master register 11 issues an order number for the sake of distinction from other orders.

After the operator receives the complete order from the customer, he depresses a serve key 22. In response to the depression of the serve key 22, acceptance of the order is ended, and the slave or master register 10 or 11 prints out an order slip 30 as shown in FIG. 4. The operator hands over this order slip 30 to the customer. The slave register 10 transmits the customer's order number and the ordered menu items to both the master register 11 and the display control unit 14 through the communication line 20. The master register 11 stores the transmitted order number and ordered menu items, and, when issue of another order number is then requested, the next order number is transmitted as the new order number.

The manner of accounting will now be described by reference to FIGS. 5 and 6. After the operator inputs the order number to the slave register 10 by manipulating the order number key 21, the slave register 10 acquires the ordered menu items stored in the master register 11 to account for the ordered menu items. Then, when the operator depresses an account key on the slave register 10, the slave register 10 erases the data of the ordered menu items stored in the memory of the master register 11 and prints out a slip 40 as shown in FIG. 6.

The display control unit 14 stores the ordered menu items received from the slave registers 10 and displays the ordered menu items on the display screen of the display unit 13 as shown in FIG. 7. The cook in the kitchen cooks the menus according to the ordered menu items displayed on the display screen of the display unit 13. As soon as the ordered menu items are prepared, the operator calls the customer by the order number to deliver the ordered menu at the service counter or directly carries the ordered menu to the table of the corresponding customer.

After a menu ordered according to an order number is cooked, the cook in the kitchen manipulates the control key 16 shown in FIG. 2 to erase the display of the order number on the display screen of the display unit 13. Therefore, the display on the display screen of the display unit 13 is controlled independently of the operation of the master register 11 or slave registers 10.

Thus, when the operator inputs an order number to any one of the slave registers 10 in the prior art electronic cash register system, and this order number is read out from the memory of the master register 11, the required accounting can be made at the slave register 10. Also, when the cook manipulates the control key 16 in the kitchen, the display of the order for the menu cooked already can be erased from the display screen of the display unit 13.

However, in the case of the prior art electronic cash register system, the operator of each of the registers was required to input the menu items ordered by a customer and hand over a slip having the printed order number to the customer, and, for the purpose of later accounting, the order number printed on the slip had to be newly inputted to the register.

Also, the cook in the kitchen had to make key manipulation in order to erase the display of the menu from the display screen of the display unit as he finished cooking. This requirement for key manipulation was troublesome and time consuming in the contact of meet in the demand for shortened service time in a restaurant, such as, a fast food restaurant. Further, because each of the registers had to issue a slip having a printed order number so as to inform the customer of the order number, such a problem arose that this slip is wasted in such a restaurant as would deliver the ordered menu to the customer consecutively after reception of order of the menu.

SUMMARY OF THE INVENTION

With a view to solve the prior art problem, it is an object of the present invention to provide an improved electronic cash register system for use in a restaurant where an order for a menu from a customer and delivery of the ordered menu to the customer proceed in sequential relation, the system including a register set of a register exclusively used for the purpose of accepting an order for a menu from a customer and another register exclusively used for the purpose of accounting for the ordered menu, the register set being provided for each of a plurality of lanes with a same linkage register number being allocated to the registers forming each set, and a display control unit storing ordered menu items together with the register linkage numbers, so that accounting for the order can be made by minimized key manipulation. Another object of the present invention is to provide a useful electronic cash register system in which the name of an ordered menu cooked and accounted already is erased without requiring troublesome manipulation by the cook from a display screen of a display unit installed in the kitchen.

An embodiment of the electronic cash register system of the present invention which attains the above objects comprises a plurality of order registers each having a register number registered beforehand and receiving the items of a menu ordered by a customer as its input, a display unit displaying the ordered menu items, a display control unit controlling the display unit and storing the ordered menu items displayed on the display unit together with the register number of each order register, and a plurality of account registers each forming a set with the associated order register and having a register number corresponding to that of the associated order register, each account register reading out the ordered menu items corresponding to the register number from the memory of the display control unit to account for the ordered menu items.

The operation of the electronic cash register system of the present invention is such that, when the operator of one of the order registers inputs the menu items ordered by a customer to the order register, the order register transmits the ordered menu items and its register number to the display control unit. The display control unit stores the ordered menu items together with the register number and displays the ordered menu items on the display screen of the display unit. The customer then moves to the account register associated with the order register for accounting for the order. The operator of the account register manipulates the account register to read out the ordered menu items stored in the memory of the display control unit. The display control unit reads out the ordered menu items corresponding to the register number of the account register and transmits the read-out ordered menu items to the account register. The operator of the account register makes necessary accounting for the read-out ordered menu items.

DESCRIPTION OF THE PREFERRED EMBODIMENTS

Preferred embodiments of the present invention will now be described by reference to the drawings.

FIRST EMBODIMENT

Figure 1:
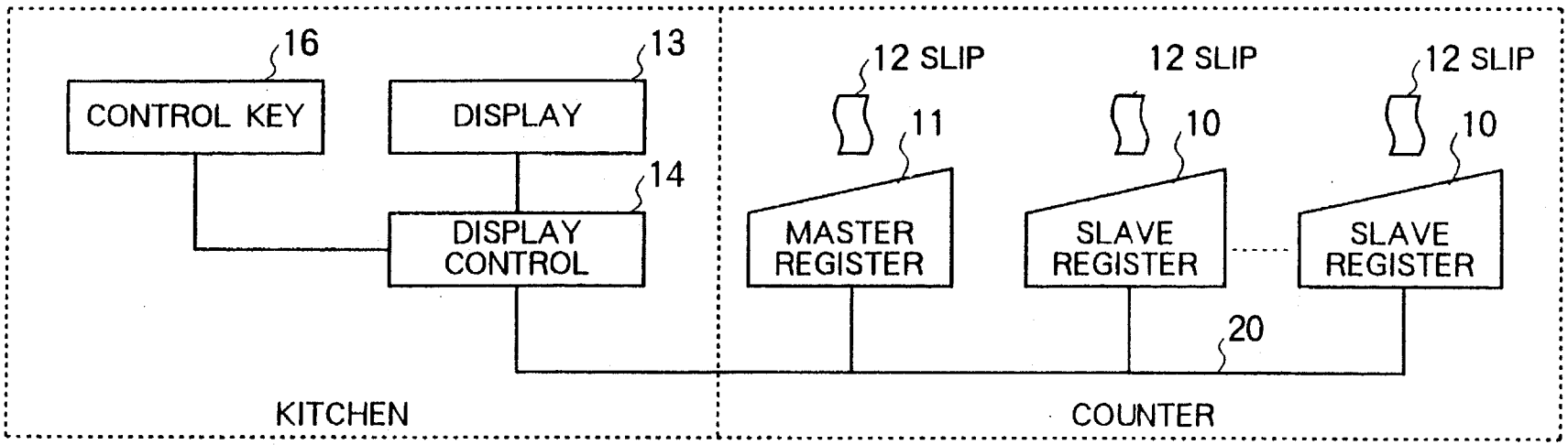
FIG. 1 PRIOR ART
FIG. 1 is a block diagram showing the structure of a prior art electronic cash register system.
Figure 2:
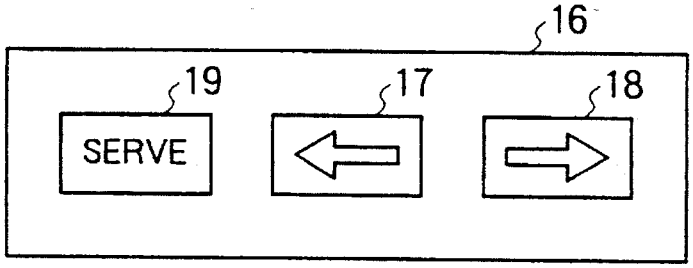
FIG. 2 PRIOR ART
FIG. 2 is an external view of the control key used in the prior art electronic cash register system.
Figure 3:
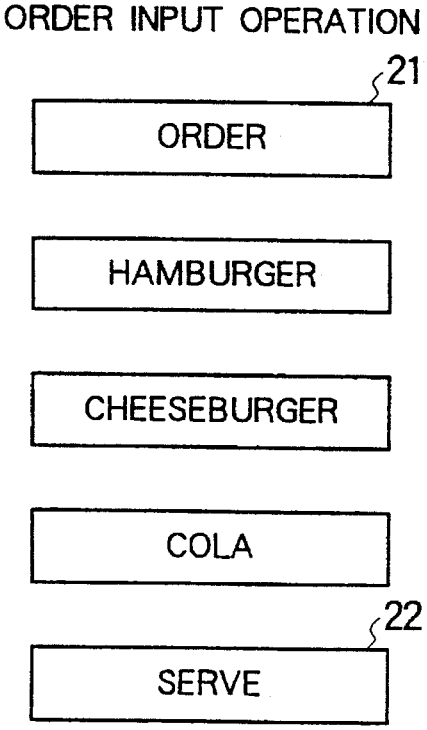
FIG. 3 PRIOR ART
FIG. 3 shows keys manipulated in response to an order input in the prior art electronic cash register system.
Figure 4:
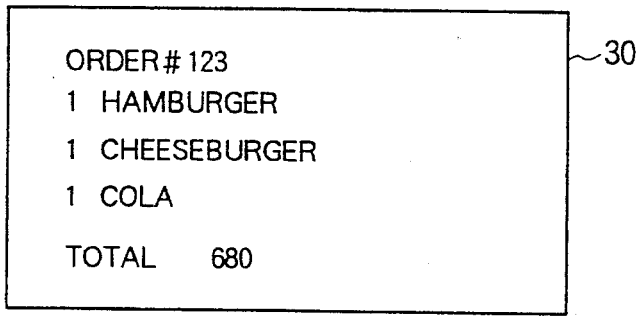
FIG. 4 PRIOR ART
FIG. 4 shows an example of a printed order slip in the prior art electronic cash register system.
Figure 5:
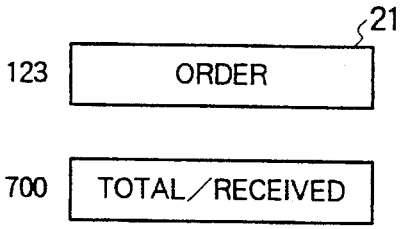
FIG. 5 PRIOR ART
FIG. 5 shows keys manipulated for accounting in the prior art electronic cash register system.
Figure 6:
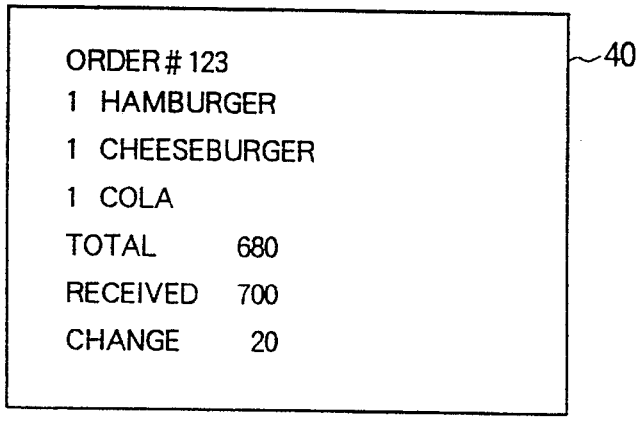
FIG. 6 PRIOR ART
FIG. 6 shows an example of a printed accounting slip in the prior art electronic cash register system.
Figure 7:
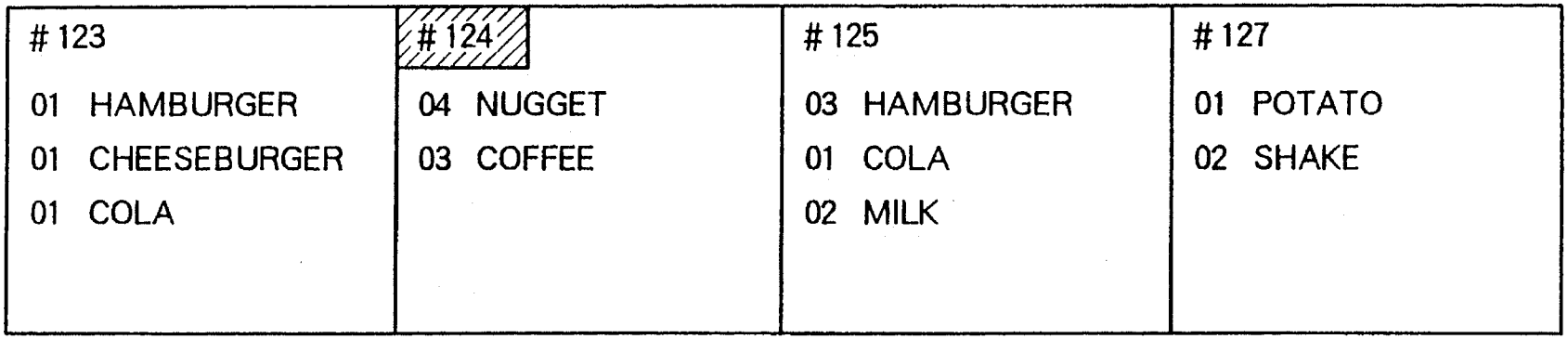
FIG. 7 PRIOR ART
FIG. 7 shows order menus displayed on the display screen of the display unit in the prior art electronic cash register system.
Figure 8:
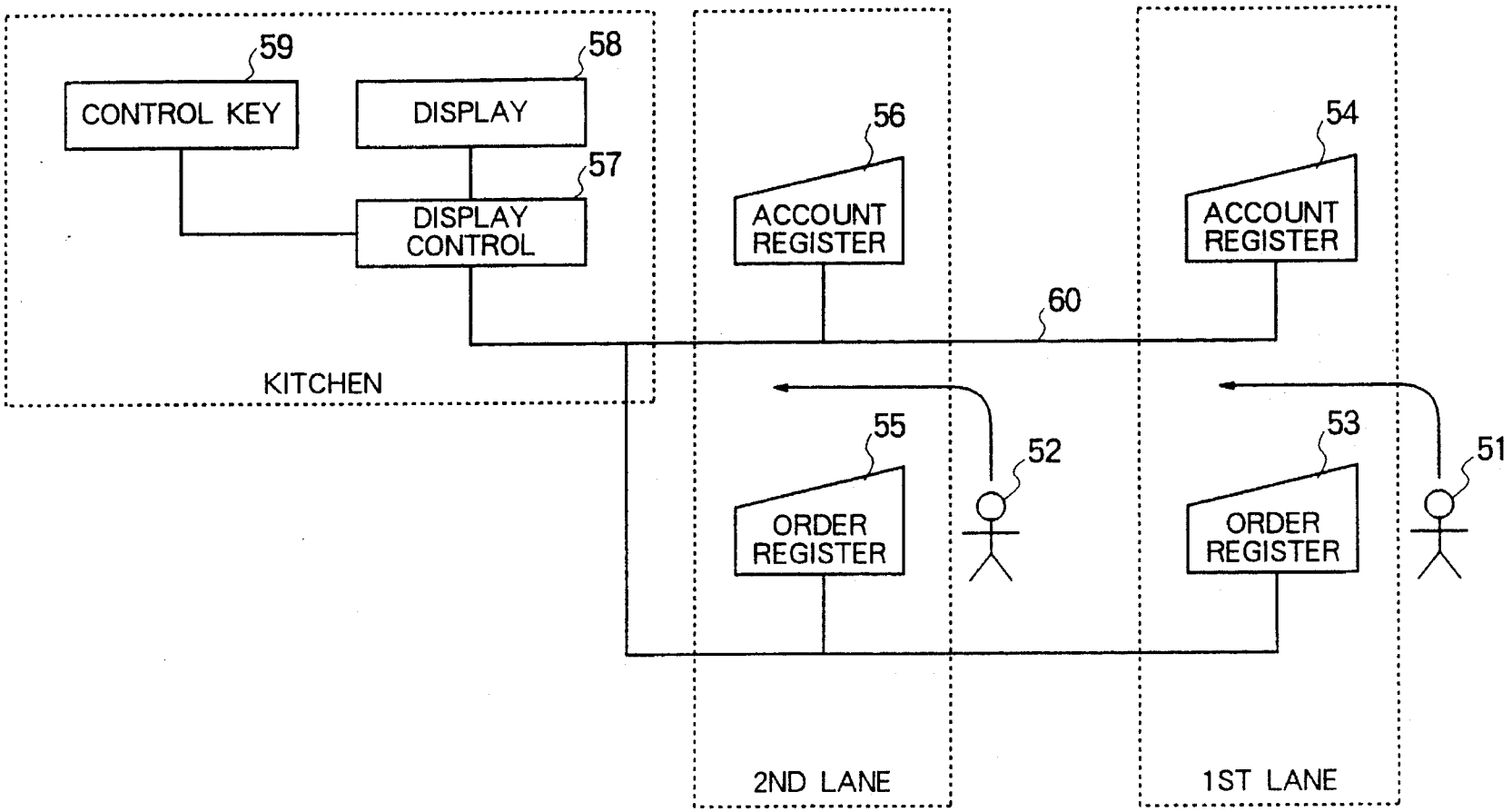
FIG. 8 is a block diagram showing the structure of a first embodiment of the electronic cash register system according to the present invention.

FIG. 8 shows the structure of a first embodiment of the electronic cash register system according to the present invention. Referring to FIG. 8, the system has two lanes, a customer 51 orders a menu in the first lane, while another customer 52 orders a menu in the second lane. An order register 53 receiving the menu items ordered by the customer 51 as its input is located in the first lane. An account register 54 accounting for the ordered menu items inputted to the order register 53 is also located in the first lane. Another order register 55 receiving the menu items ordered by the customer 52 as its input is located in the second lane. Another account register 56 accounting for the ordered menu items inputted to the order register 54 is also located in the second lane. A linkage register number "1" is allocated to the combination of the order register 53 and the account register 54 located in the first lane, while another linkage register number "2" is allocated to the combination of the order register 55 and the account register 56 located in the second lane.

A display unit 58 is a means for displaying the menu items of the orders inputted to the order registers 53 and 55. A display control unit 57 is a means for controlling the display unit 58 and stores the ordered menu items and the linkage register numbers in the order of the accepted orders. A control key 59 is an actuator means for displaying the ordered menus on the display screen of the display unit 58 and is connected to the display control unit 57. The order registers 53, 55, the account registers 54, 56 and the display control unit 57 are interconnected by a communication line 60.

Figure 9:
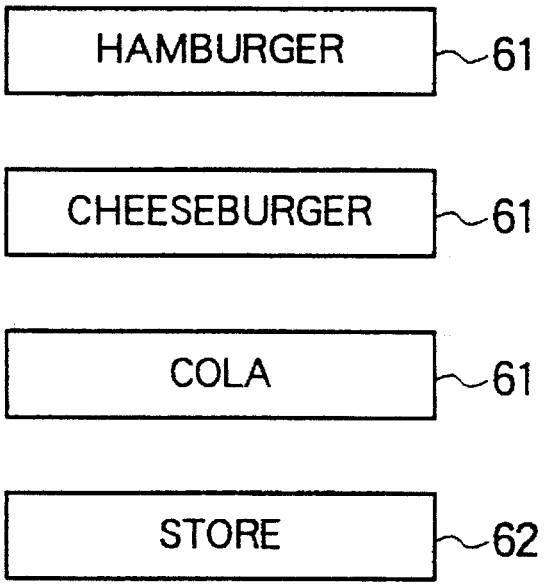
FIG. 9 shows keys manipulated in response to an order input to the order register in the first embodiment of the present invention.

FIG. 9 shows keys used for inputting an order to the order registers 53 and 55. Referring to FIG. 9, menu item keys 61 are provided on each of the order registers 53 and 55 to be used to input menu items ordered by the customers 51 and 52 to the registers 53 and 55. A store key 62 is provided on each of the order registers 53 and 55 to be used to indicate the end of the order by the customer.

Figure 10:
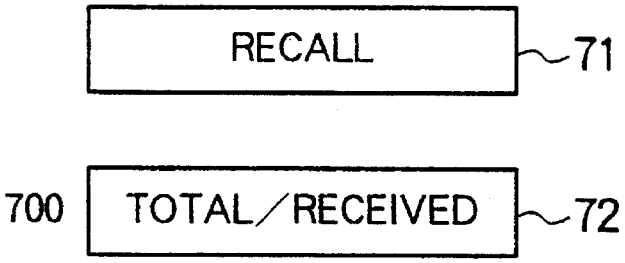
FIG. 10 shows keys manipulated for accounting at the account register in the first embodiment of the present invention.

FIG. 10 shows keys used for accounting by the account registers 54 and 56. Referring to FIG. 10, a recall key 71 is provided on each of the account registers 54 and 56 to be used to read out the ordered menu items stored in the memory of the display control unit 57. When the operator depresses the recall key 71 on the account register 54 located in the first lane, the ordered menu items registered at the order register 53, that is, those having the linkage register number "1" are read out from among those stored in the memory of the display control unit 57. When a plurality of orders having the linkage register number "1" are stored in the memory of the display control unit 57, the account register 54 reads out the order accepted earliest of all. The same applies also to the account register 56 located in the second lane. An account key 72 is provided on each of the account registers 54 and 56 to be used to instruct accounting for the ordered menu items read out from the memory of the display control unit 57.

Figure 11:
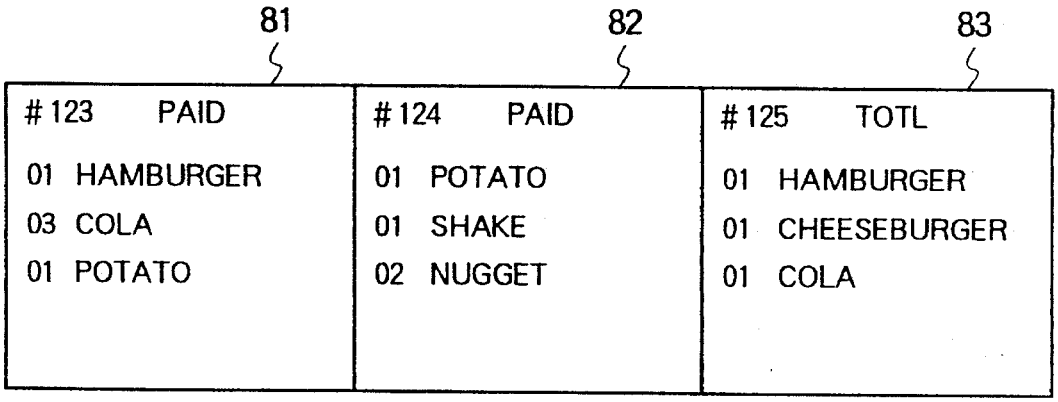
FIG. 11 shows order menus displayed on the display screen of the display unit in the first embodiment of the present invention.

FIG. 11 shows displays on the display screen of the display unit 58. Referring to FIG. 11, ordered menus 81, 82 and 83 are displayed on the display screen of the display unit 58 installed in the kitchen. In the case of the menus 81 and 82, money has been already accounted at the account registers 54 and 56, and the word "PAID" is displayed together with the ordered menu items as shown. On the other hand, in the case of the menu 83, the order by the customer has been fixed, and the word "TOTL" is displayed together with the ordered menu items as shown.

Figure 12:
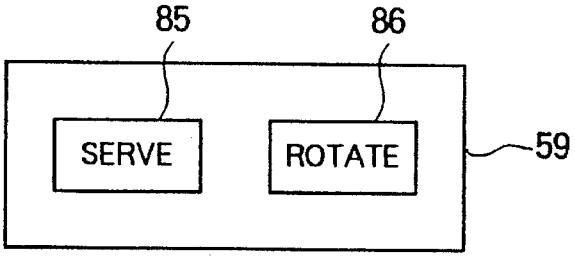
FIG. 12 is an external view of the control key used in the first embodiment of the present invention.

FIG. 12 shows keys manipulated for the purpose of control. Referring to FIG. 12, the control key 59 consists of a serve key 85 and a rotate key 86. The serve key 85 is used to instruct the display control unit 57 to erase the ordered menu displayed on the display screen of the display unit 58. The rotate key 86 is used to input an instruction to the display control unit 57. In response to this instruction, the order of the ordered menus 81 to 83 displayed on the display screen of the display unit 58 is exchanged.

Figure 13:
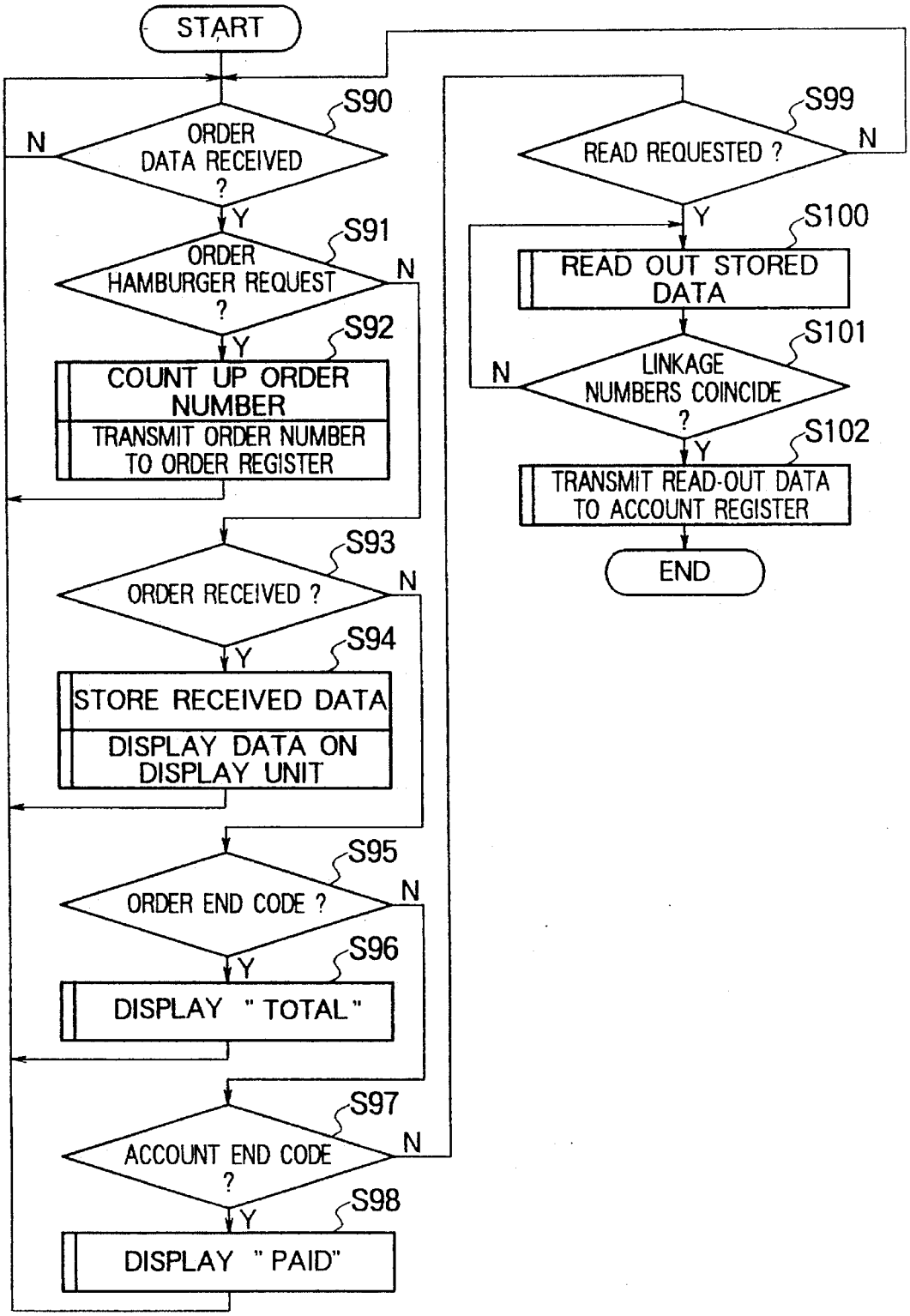
FIG. 13 is a flow chart of the control operation of the display control unit in the first embodiment of the present invention.

FIG. 13 is a flow chart of the control operation of the display control unit 57 incorporated in the first embodiment of the electronic cash register system according to the present invention. The operation of the electronic cash register system embodying the first aspect of the present invention, when installed in a fast food restaurant having two lanes dealing with orders from customers, will now be described. In the fast food restaurant of this type, an order by a customer and accounting for the order are made separately in each lane. That is, after the customer 51 in the first lane in FIG. 8 orders a menu at the order register 53 (the linkage register number "1"), the customer 51 moves to the account register 54 to pay money for the order. Thus, the order by the customer and the accounting are orderly processed. Similarly, after the customer 52 in the second lane orders a menu at the order register 55 (the linkage register number "2"), the customer 52 moves to the account register 56 to pay money for the order. The operation of the electronic cash registers of the present invention in the second lane is similar to that in the first lane. Therefore, the operation in the second lane will not be specifically described herein.

Referring to FIGS. 8 and 13, the operator (not shown) of the order register 53 depresses the menu item keys 61 shown in FIG. 9 to input the menu items ordered by the customer 51 to the order register 53. When the data is inputted to the order register 53 or the account register 54, the display control unit 57 receives the data through the communication line 60 in a step S90. When one of the menu item keys 61 is first depressed on the order register 53, the display control unit 57 decides in a step S91 that the order register 53 requests issue of the order number.

When the display control unit 57 decides that the order register 53 requests issue of the order number, the display control unit 57 counts up the order number in a step S92 and transmits the requested order number to the order register 53. When the display control unit 57 decides in a step S93 that the order register 53 does not request issue of the order number, the display control unit 57 receives through the communication line 60 the ordered menu items inputted to the order register 53. In a step S94, the display control unit 57 stores the ordered menu items and the order number in its memory together with the linkage register number "1". Also, the display control unit 57 transmits the ordered menu items and the order number to the display unit 58 to display those data on the display screen of the display unit 58.

When the operator depresses the store key 62 on the order register 53, the display control unit 57 decides in a step S95 that the order by the customer 51 is ended and displays in a step S96 the word "TOTL" as shown in FIG. 11 on the display screen of the display unit 58 together with the ordered menu items and the order number. Then, when the account key 72 shown in FIG. 10 is depressed on the account register 54 in a step S97, the word "PAID" as shown in FIG. 11 is displayed together with the ordered menu items and the order number on the display screen of the display unit 58 in a step S98 under control of the display control unit 57.

When the operator depresses the recall key 71 shown in FIG. 10 on the account register 54 in a step S99, the display control unit 57 reads out in a step S100 the ordered menu items and the order numbers stored in its memory. In a step S101, the display control unit 57 reads out from the memory the ordered menu items having the linkage register number "1" of the account register 54 and stored earliest of all among those stored in the memory. Then, in a step S102, the display control unit 57 transmits the read-out ordered menu items to the requesting account register 54. After the ordered menu items are read out, the operator depresses the account key 72 shown in FIG. 10 on the account register 54. In the step S97, the display control unit 57 decides that the accounting is ended, and, in the step S98, the word "PAID" is displayed on the display screen of the display unit 58.

Referring to FIGS. 11 and 12, the cook looking at the display screen of the display unit 58 in the kitchen decides that the order by the customer has been determined already for the menu displayed with the word "TOTL" and prepares to deal with the order. On the other hand, in the case of the menu displayed with the word "PAID", the cook decides that the customer has paid money already and manipulates the serve key 85 and the rotate key 86 to erase the menu from the display screen of the display unit 58.

Thus, in a fast food restaurant, for example, a drive-through restaurant where an order by a customer and accounting for the order are separately made in each of a plurality of lanes, the ordered menu items received at each order register are registered together with the linkage register number in the display control unit, and the account register located in the same lane as that of the order register automatically reads out the ordered menu items having the same linkage register number and registered earliest of all, so that the required ordered menu items can be immediately read out for the purpose of accounting without requiring manipulation for reading out according to, for example, the order number.

Thus, the ordered menu items received at each order register are registered together with the linkage register number in the display control unit, and the account register located in the same lane as that of the order register automatically reads out the ordered menu items having the same linkage register number and registered earliest of all. Then, the order number of the order by the customer is issued, and a slip having the printed order number and ordered menu items is handed over from the operator to the customer. At the time of accounting, the ordered menu items can be immediately read out from the memory of the display control unit for the purpose of accounting without requiring the step of reading out the ordered menu items from the memory of the display control unit by referring to the order number printed on the slip. Because the ordered menu items can be registered in the memory of the display control unit in the accepted order and without regard to the linkage register number, the ordered menu items can also be displayed in the accepted order on the display screen of the display unit installed in the kitchen under control of the display control unit.

SECOND EMBODIMENT

Figure 14:
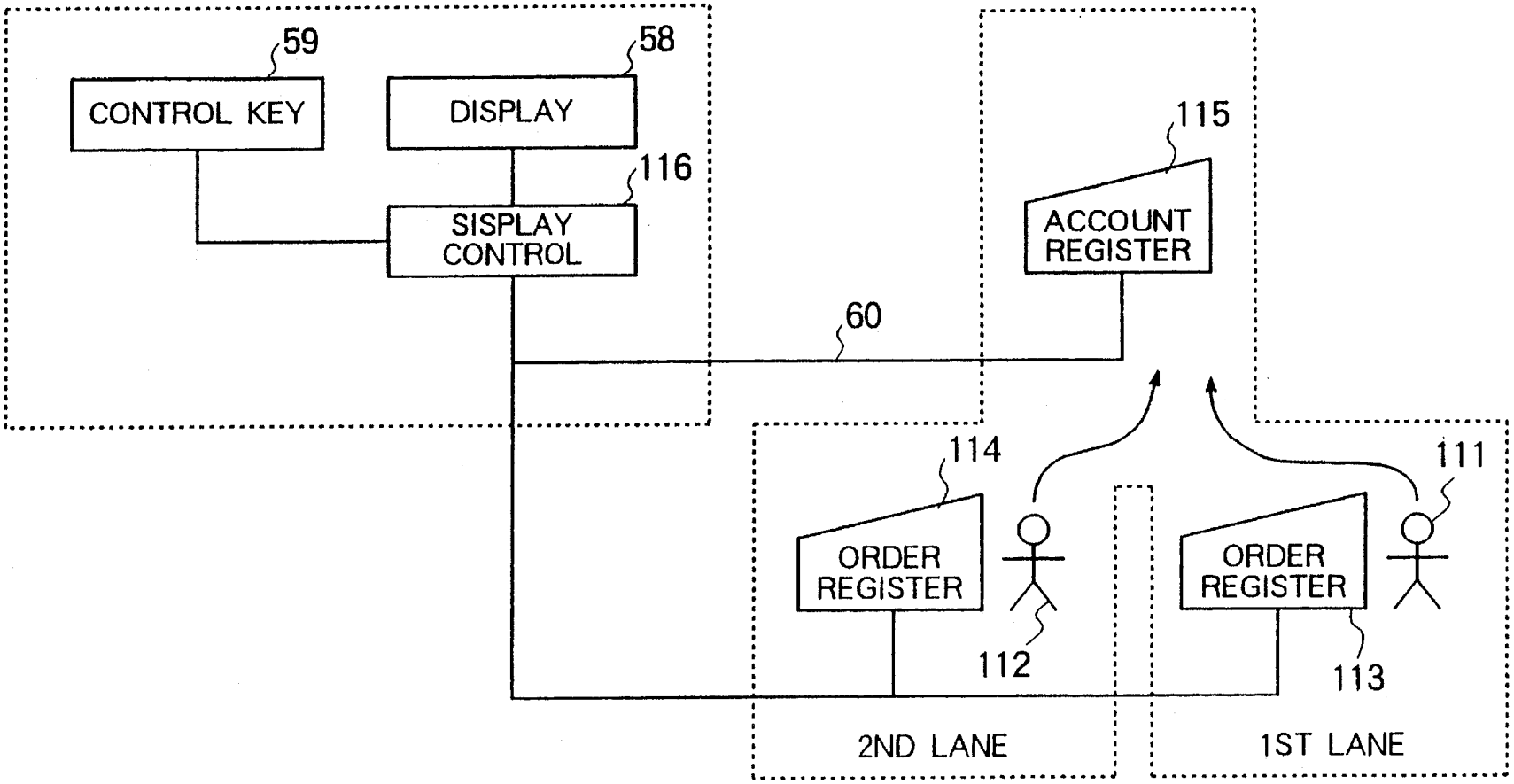
FIG. 14 is a block diagram showing the structure of a second embodiment of the electronic cash register system according to the present invention.

FIG. 14 shows the structure of a second embodiment of the electronic cash register system according to the present invention. This second embodiment is a partial modification of the first embodiment. Referring to FIG. 14, a customer 111 in a first lane orders a menu, while another customer 112 in a second lane also orders a menu. An order register 113 receiving the menu items ordered by the customer 111 as its input is located in the first lane and has a linkage register number "1", while another order register 114 receiving the menu items ordered by the customer 112 as its input is located in the second lane and has also the linkage register number "1".

An account register 115 accounts for the ordered menu items inputted to the order registers 113 and 114 and has also the linkage register number "1". A display control unit 116 is a means for controlling the display unit 58 and stores in its memory the ordered menu item inputs to the order registers 113 and 114 in the accepted order. When there are a plurality of combinations of one account register for every two lanes, the linkage register number is provided for each combination, and the display control unit 116 stores the ordered menu items and the linkage register numbers in the accepted order.

Figure 15:
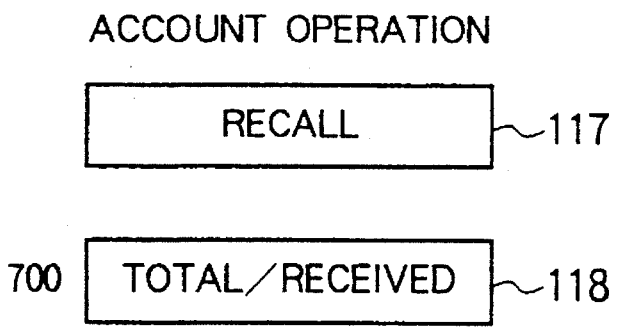
FIG. 15 shows keys manipulated for accounting at the account register in the second embodiment of the present invention.

FIG. 15 shows keys manipulated for accounting. A recall key 117 provided on the account register 115 is used to read out the ordered menu items stored in the memory of the display control unit 116. When the operator of the account register 115 depresses the recall key 117 on the account register 115, the ordered menu items stored earliest of all are read out from among those stored in the memory. An account key 118 instructs accounting by the account register 115 for the ordered menu items read out from the memory of the display control unit 116.

Figure 16:
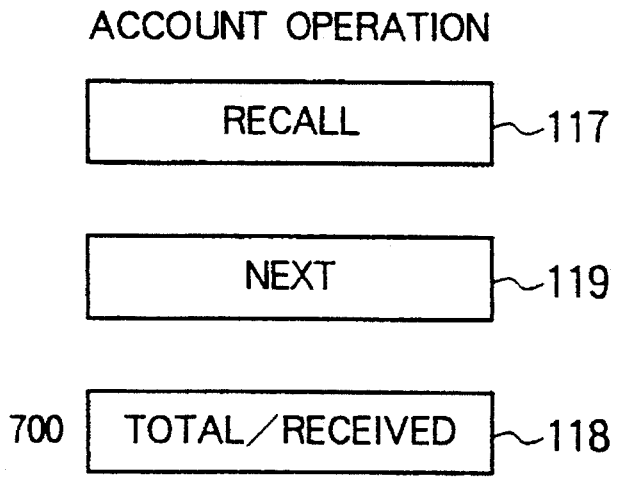
FIG. 16 shows a key manipulated at the account register when the menu items read out from the display control unit do not coincide with those ordered by the customer in the second embodiment of the present invention.

FIG. 16 shows a key manipulated on the account register 115 when the ordered menu items read out from the memory of the display control unit 116 do not coincide with those of the order by the customer. A next key 119 shown in FIG. 16 is provided on the account register 115 together with the recall key 117 and the account key 118. When the operator depresses the next key 119, the account register 115 reads out the ordered menu items stored next to those read out already from the memory of the display control unit 116.

Figure 17:
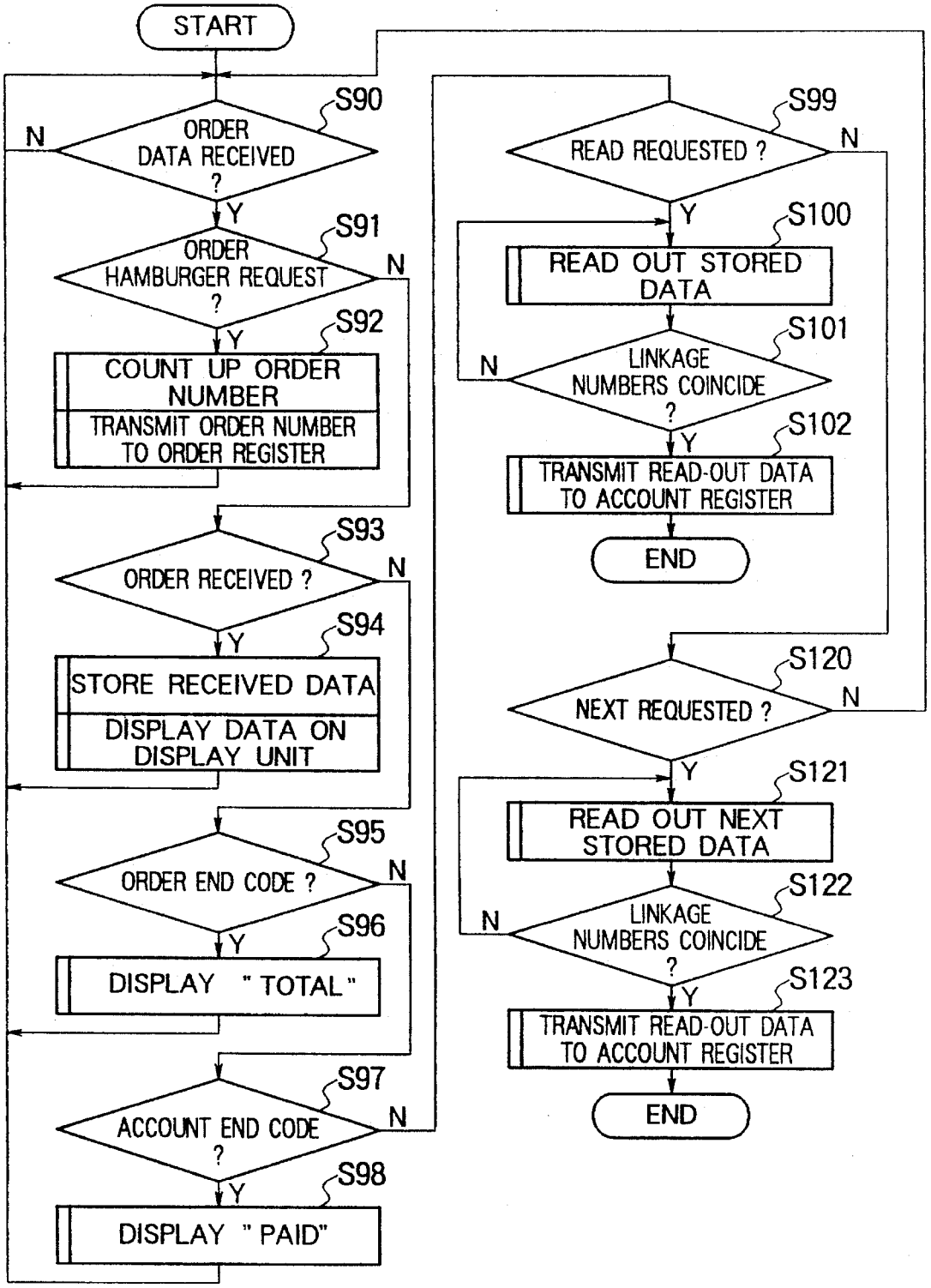
FIG. 17 is a flow chart of the control operation of the display control unit in the second embodiment of the present invention.

FIG. 17 is a flow chart of the control operation of the display control unit 116 incorporated in the second embodiment of the electronic cash register system according to the present invention. The operation will be described by reference to the application of the embodiment to a fast food restaurant where the two order registers are provided in the individual lanes to deal with orders by the customers, and only one account register is provided for the purpose of accounting. Referring to FIG. 14, the customer 111 orders a menu at the order register 113 (the linkage register number "1") in the first lane. The customer 111 having ordered the menu moves then to the account register 115 (the linkage register number "1") to pay money for the order. On the other hand, the customer 112 orders a menu at the order register 114 (the same linkage register number "1" as that of the order register 113) in the second lane. The customer 112 having ordered the menu then moves to the account register 115 (the linkage register number "1") to pay money for the order. The account register 115 makes accounting in the order in which the customers finished their orders regardless of whether they are in the first or second lane. In FIG. 17, the control flow in steps S90 to S102 is similar to that in the first embodiment, and, in this embodiment, the control flow starting from the step S99 will only be described.

When the customer 111 or 112 (the customer 111 in this embodiment) pays money at the account register 115, the operator depresses the recall key 117 in the step S99 to read out the ordered menu items stored in the memory of the display control unit 116. In this case, the account register 115 reads out the ordered menu items registered earliest of all from among those stored in the memory of the display control unit 116.

When the ordered menu items read out from the memory of the display control unit 116 differ from those ordered by the customer 111, the operator of the account register 115 depresses the next key 119 provided on the account register 115. In a step S120, the account register 115 requests the display control unit 116 to read out the ordered menu items stored next to those read out already.

In a step S121, the display control unit 116 reads out the ordered menu items accepted next to those transmitted already to the account register 115. When the next ordered menu items thus read out still differ from those ordered by the customer 111, the operator continues to depress the next key 119 until the ordered menu items stored in and read out from the memory of the display control unit 116 coincide with those ordered by the customer 111.

Further, when the display control unit 116 stores the ordered menu items to be accounted by a plurality of account registers (when there are a plurality of combinations each consisting of one account register and two lanes), the display control unit 116 reads out in a step S122 the ordered menu items having the same linkage register number as that of the account register requesting to read out the ordered menu items. In a step S123, the display control unit 116 transmits the ordered menu items read out from the memory.

Thus, according to the second embodiment of the present invention, the ordered menu items stored in the memory of the display control unit are successively selected in the accepted order by the account register for accounting.

THIRD EMBODIMENT

Figure 18:
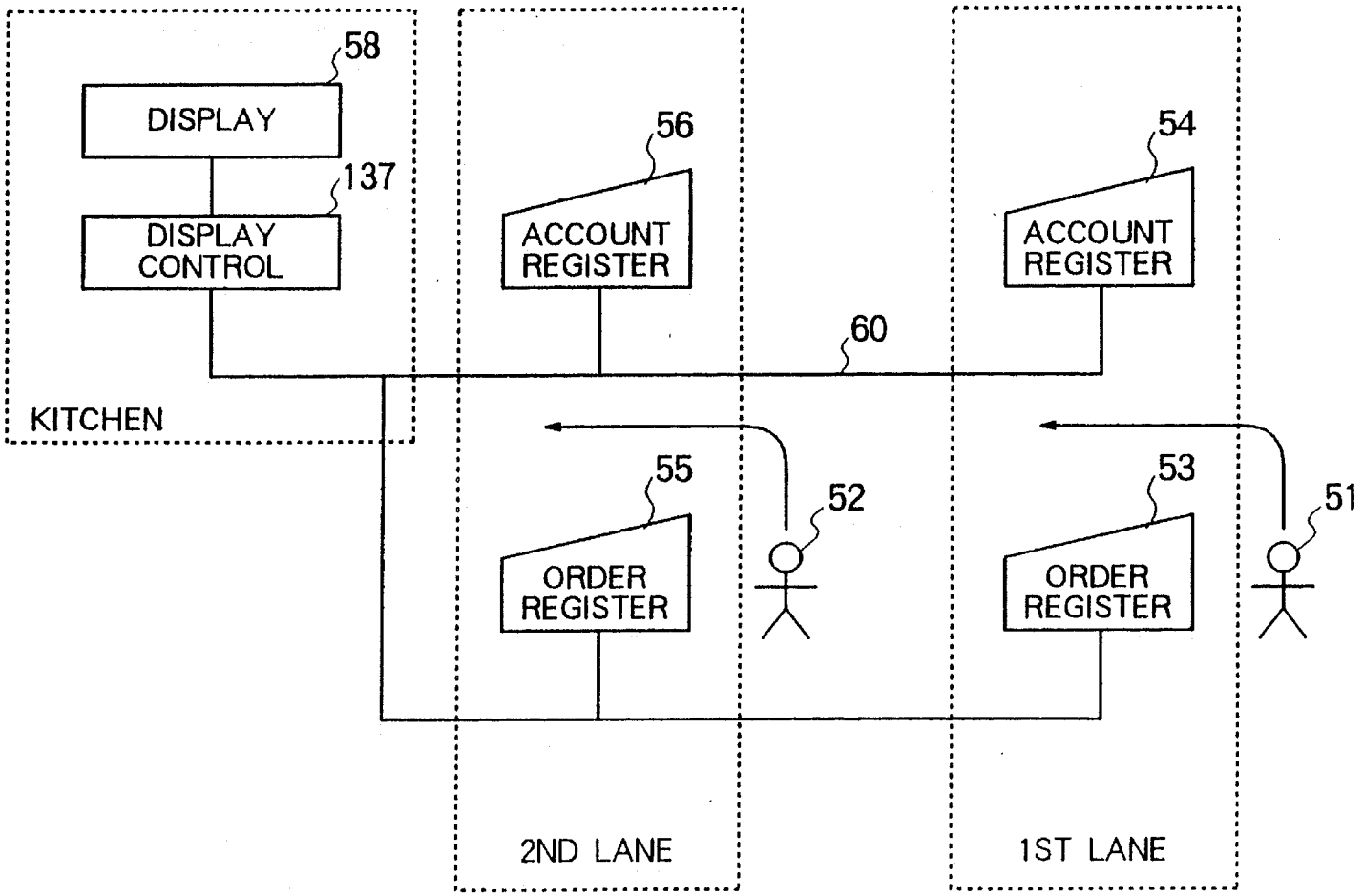
FIG. 18 is a block diagram showing the structure of a third embodiment of the electronic cash register system according to the present invention.

FIG. 18 shows the structure of a third embodiment of the electronic cash register system according to the present invention. This third embodiment is a partial modification of the first embodiment. Referring to FIG. 18, the customer 51 in the first lane orders a menu, while the customer 52 in the second lane orders a menu. The order register 53 receiving the menu items ordered by the customer 51 as its input is located in the first lane. The account register 54 accounting for the ordered menu items inputted to the order register 53 is also located in the first lane.

The order register 55 receiving the menu items ordered by the customer 52 as its input is located in the second lane. The account register 56 accounting for the ordered menu items inputted to the order register 55 is also located in the second lane. The linkage register number "1" is allocated to each of the order register 53 and the account register 54 located in the first lane, while the linkage register number "2" is allocated to each of the order register 55 and the account register 56 located in the second lane. The display unit 58 which is the means for displaying the ordered menu items inputted to the order registers 53 and 55 is installed in the kitchen. A display control unit 137 which is a means for controlling the display unit 58 stores the ordered menu items inputted to the order registers 53 and 55 in its memory in the accepted order together with the linkage register numbers.

Figure 19:
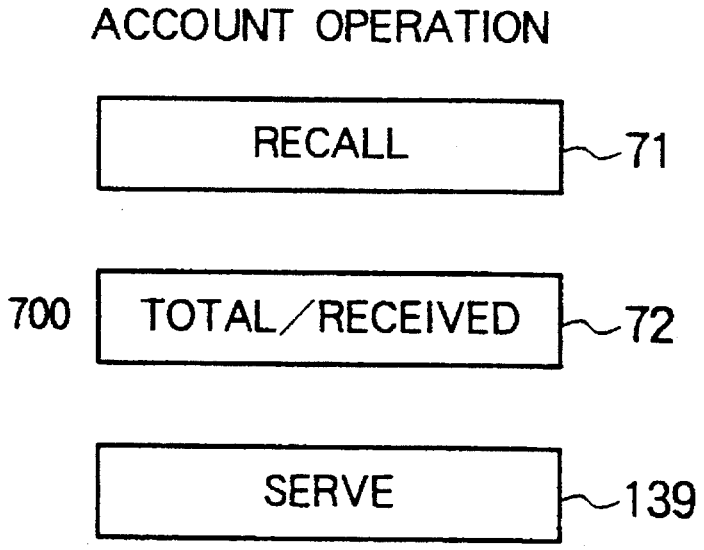
FIG. 19 shows keys manipulated for accounting at the account register in the third embodiment of the present invention.

FIG. 19 shows the keys manipulated for accounting by each of the account registers 54 and 56. The recall key 71 provided on each of the account registers 54 and 56 is used to read out the ordered menu items stored in the memory of the display control unit 137. When the operator depresses the recall key 71 on the account register 54 located in the first lane, the ordered menu items inputted to the order register 53, that is, the ordered menu items having the linkage register number "1" are read out from among those stored in the memory of the display control unit 137.

Further, when a plurality of orders having the linkage register number "1" are stored, the account register 54 reads out that accepted earliest of all. The same applies also to the account register 56 located in the second lane. The account key 72 provided on each of the account registers 54 and 56 is used for instructing accounting for the ordered menu items read out from the memory of the display control unit 137. A serve key 139 is provided on each of the account registers 54 and 56. When this serve key 139 is depressed, each of the account registers 54 and 56 transmits to the display control unit 137 an instruction for erasing the data of the ordered menu items read out from the memory of the display control unit 137 in response to the depression of the recall key 71 and also an instruction for erasing the ordered menu items displayed on the display screen of the display unit 58 installed in the kitchen.

Figure 20:
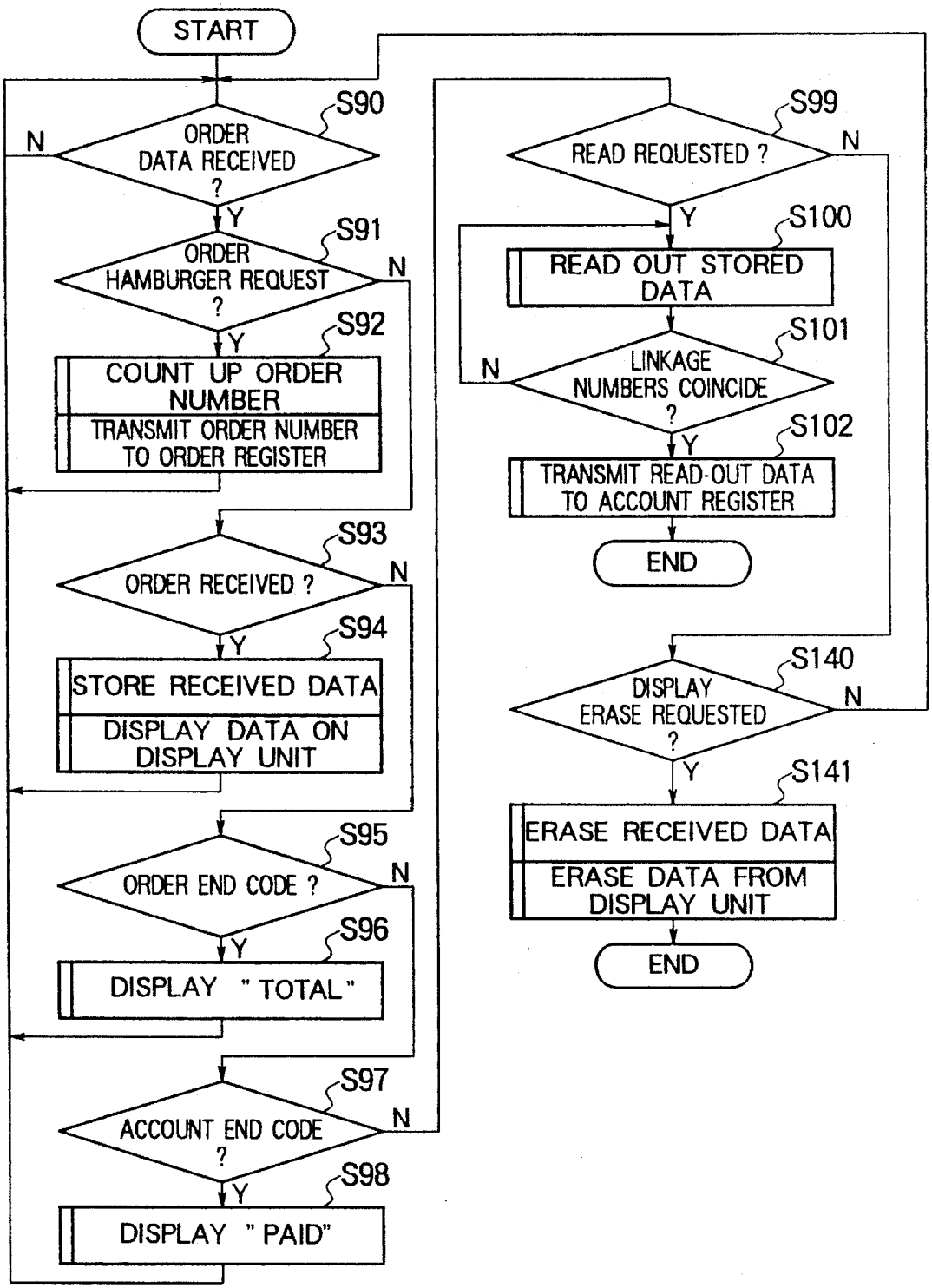
FIG. 20 is a flow chart of the control operation of the display control unit in the third embodiment of the present invention.

FIG. 20 is a flow chart of the control operation of the display control unit 137 incorporated in the third embodiment of the present invention. The flow chart will be described by reference to the application of the third embodiment of the present invention to a fast food restaurant where there are two lanes for dealing with orders by customers, so that accounting and delivery of ordered menus can be made at the same time. The control flow in the steps S90 to S102 is the same as that in the first embodiment.

After accounting for the order by the customer 51 in the steps S90 to S98, the operator depresses the serve key 139 on the account register 54. In response to the depression of the serve key 39, the account register 54 transmits in a step S140 to the display control unit 137 an instruction for erasing the data of the ordered menu items accounted already and also an instruction for erasing the ordered menu items displayed on the display screen of the display unit 58. In a step S141, the display control unit 137 erases the data of the ordered menu items requested from the account register 54 and also erases the ordered menu items displayed on the display screen of the display unit 58.

Thus, according to the third embodiment of the present invention, the operator of the account register manipulates the account register to transmit the instruction to erase the data of the ordered menu items accounted already from the display screen of the display unit, so that the cook in the kitchen need not make troublesome manipulation for erasing the ordered menu items accounted already from the display screen of the display unit.

It will be apparent from the above description that the first embodiment of the electronic cash register system according to the present invention comprises a plurality of order registers each having a register number registered beforehand and receiving the items of a menu ordered by a customer as its input, a display unit displaying the ordered menu items, a display control unit controlling the display unit and storing the ordered menu items displayed on the display unit together with the register number of each order register, and a plurality of account registers each forming a set with the associated order register and having a register number corresponding to that of the associated order register, each account register reading out the ordered menu items corresponding to the register number from the memory of the display control unit to account for the ordered menu items.

The ordered menu items received at each order register are registered together with the linkage register number in the display control unit, and the account register located in the same lane as that of the order register automatically reads out the ordered menu items having the same linkage number and registered earliest of all. Then, the order number of the order by the customer is issued, and a slip having the printed order number and ordered menu items is handed over to the customer. At the time of accounting, the ordered menu items can be immediately read out from the memory of the display control unit for the purpose of accounting without requiring the step of reading out the ordered menu items from the memory of the display control unit by referring to the order number printed on the slip. Thus, the first embodiment of the present invention is advantageous in that, at the time of accounting, the customer need not return the slip accepted at the time of ordering, so that an input miss tending to occur when the operator manipulates the account register while referring to the order number printed on the slip can be avoided. Further, because the ordered menu items can be registered in the memory of the display control unit in the accepted order and without regard to the linkage register number, the first embodiment of the present invention is also advantageous in that the display control unit registers the ordered menu items and displays the ordered menu items in the registered order on the display screen of the display unit installed in the kitchen, so that the cook can prepare the ordered menus in the accepted order.

It will be further apparent from the above description that the second embodiment of the electronic cash register system according to the present invention comprises an account register associated with a plurality of order registers for successively reading out ordered menu items from data stored in a display control unit and successively selecting the ordered menu items in the accepted order from the memory of the display control unit, so that only one account register can account for the menu items ordered at the plural order registers. Thus, the second embodiment of the present invention is advantageous in that a minimum number of account registers can account for the ordered menu items accepted at a plurality of order registers without requiring the step of handing over slips having printed order numbers to the customers. The second embodiment of the present invention is also advantageous in that, even when the ordered menu items read out from the memory of the display control unit differ from those ordered by the customer, the account register can easily read out the next ordered menu items from the memory of the display control unit.

It will be further apparent from the above description that the third embodiment of the electronic cash register system according to the present invention comprises a display control unit which, when an account register accounts for menu items ordered at an order register, erases the ordered menu items from the display screen of a display unit and also erases the ordered menu items stored in its internal memory, so that the ordered menu items accounted already are erased from the display screen of the display unit, and the ordered menu items stored in the memory of the display control unit are also automatically erased. Thus, because the ordered menu items to be cooked by the cook are displayed on the display screen of the display unit without requiring manipulation by the cook, the cook cooking the menu while looking at the ordered menu items displayed on the display screen of the display unit can quickly and reliably deal with the order by the customer.

I claim:

1. An electronic cash register system comprising:

a plurality of order registers each having a register number and for receiving content of orders;

a display unit for displaying the content of orders received by said plurality of order registers;

a display control unit having an internal memory, for controlling display on said display unit and successively storing in said internal memory a plurality of said content of orders received by said plurality of order registers in association with the register number of the one of said plurality of order registers which received one of said plurality of content of orders; and a plurality of account registers each associated with at least one of said plurality of order registers and having its own register number corresponding to that of said at least one of said plurality of order registers and for reading out the content of orders from the internal memory of said display control unit on the basis of said own register number and then accounting for the read-out content of orders.

2. An electronic cash register system according to claim 1, wherein:

at least one of said plurality of account registers is associated with more than one of said plurality of order registers and is operable to successively read out the content of orders received by said more than one of said plurality of order registers from said internal memory of said display control unit and to exchangeably control an order of reading out the content of orders received by said more than one of said plurality of order registers.

3. An electronic cash register system according to claim 1, wherein:

after one of said plurality of account registers accounts for the content of orders received by an associated one of said plurality of order registers, said display control unit erases the display of the content of orders received by said associated one of said plurality of order registers from the display screen of said display unit and also erases the content of orders received by said associated one of said plurality of order registers from said internal memory of said display control unit.

4. An electronic cash register system according to claim 1, wherein:

each of said plurality of account resisters is associated with a respective one of said plurality of order registers.

* * * * *